United States Patent [19]

Johnson

[11] Patent Number: 4,731,015

[45] Date of Patent: Mar. 15, 1988

[54] BURNER UNIT

[76] Inventor: Arthur C. W. Johnson, 2611 Lake Charnwood, Troy, Mich. 48084

[21] Appl. No.: 899,235

[22] Filed: Aug. 22, 1986

[51] Int. Cl.[4] ..... F23D 11/36; F24C 3/00

[52] U.S. Cl. ..... 431/154; 431/353; 126/91 A; 29/157 R

[58] Field of Search ..... 431/154, 353; 126/91 A, 126/360; 432/147, 175, 209; 29/157 R, 469

[56] References Cited

U.S. PATENT DOCUMENTS

| | | | |
|---|---|---|---|
| 2,111,484 | 3/1938 | Woodson | 126/91 A X |
| 2,606,549 | 8/1952 | Smith | 126/91 A X |
| 2,617,407 | 11/1952 | Johnson | 126/91 A X |
| 3,162,239 | 12/1964 | Irons | 126/360 |
| 4,044,751 | 8/1977 | Johnson | 126/91 A |

FOREIGN PATENT DOCUMENTS

| | | | |
|---|---|---|---|
| 1495383 | 12/1977 | United Kingdom | 126/91 A |

*Primary Examiner*—Margaret A. Focarino
*Attorney, Agent, or Firm*—Krass & Young

[57] ABSTRACT

A burner unit comprising three simple subassemblies which may be readily assembled to form the completed burner unit. The subassemblies include a front housing assembly including a front disk and a front tube; a back housing assembly including a back disk and a back tube; and a burner subassembly including a burner nozzle and a control assembly offset with respect to the central axis of the burner nozzle. The burner is assembled by inserting the burner nozzle into the inboard end of the front tube of the front housing subassembly to position the burner nozzle, in coaxial relation within the front tube and position the control assembly in an offset position relative to the axis of the front tube and the burner nozzle, whereafter the inboard end of the back tube of the back housing subassembly is telescoped over the inboard end of the front tube of the front housing subassembly and a suitable dust cover is positioned over the outer peripheries of the disks of the front and back housing subassemblies to complete the enclosure. Coacting slots and cutouts in the inboard ends of the telescoped tubes coact to define an opening allowing the piping interconnecting the burner nozzle and the control assembly to pass outwardly through the telescoped tubes.

15 Claims, 8 Drawing Figures

BURNER UNIT

INTRODUCTION

This invention relates to a burner unit and more particularly to a burner unit which is of simplified construction and which is amenable to a simplified assembly process.

Burner units for space heating, utilizing gas, oil or other fuel, are available in a multitude of sizes and configurations depending upon the particular space heating application envisioned. Whereas the available burner units are generally suitable for their intended purposes, the units tend to be overly complex either in their construction or in the required method of assembly. Since the burner unit industry is extremely competitive, any reductions in material cost or assembly cost are very significant.

SUMMARY OF THE INVENTION

This invention is directed to a burner unit of simplified construction and allowing a simplified method of assembly.

According to the basic assembly methodology of the invention, a plurality of subassemblies are prepared and the subassemblies are thereafter assembled together in an efficacious manner.

Specifically, a burner subassembly is prepared including a control assembly, a burner nozzle, and piping interconnecting the outlet of the control assembly to the inlet of the burner nozzle and positioning the control assembly in a laterally offset position relative to the central axis of the burner nozzle; a front housing subassembly is prepared including a front flange plate and a front tube passing through an aperture in the front flange plate; a back housing subassembly is prepared including a back flange plate and a back tube passing through an aperture in the back flange plate; the burner nozzle of the burner subassembly is inserted into the inboard end of the tube of the front housing subassembly to position the burner nozzle in coaxial relation within the front tube and position the control assembly in an offset position relative to the axes of the front tube and the burner nozzle; the back tube of the back housing subassembly is positioned in coaxial relation to the front tube of the front housing subassembly; the inboard ends of the front and back tubes are coupled together to position the front and back flange plates in axially spaced relation and position the control assembly between the front and back flange plates outside of the aligned and coupled inboard ends of the tubes; and an axially extending annular cover is positioned over the peripheral edges of the front and back flange plates to form an enclosure enclosing the control assembly and the coupled inboard ends of the front and back tubes. This simplified assembly procedure allows the burner unit to be assembled in significantly less time than prior art burner units and using less skilled labor.

According to a further feature of the invention methodology, the coupled inboard ends of the front and back tubes define an opening in the side wall of the coupled tubes and the piping of the burner subassembly includes a laterally extending portion which passes through the opening in the coupled inboard ends of the tubes in the assembled condition of the burner unit. This arrangement simplifies the positioning of the burner nozzle within the front tube of the front housing subassembly and simultaneously positions the control assembly in a position laterally offset from the central axis of the aligned tubes.

According to a further feature of the invention methodology, an axial slot is provided in the front tube opening at the inboard end of the front tube; as the burner nozzle is inserted into the front tube, the laterally extending portion of the piping of the burner subassembly is slid axially into the slot; and the inboard end of the back tube is fitted telescopically over the inboard end of the front tube and the inboard annular end edge of the back tube traps the laterally extending piping portion in the blind end of the slot. This specific arrangement further facilitates the rapid positioning of the burner nozzle in the front tube and the rapid positioning of the piping of the burner subassembly in a position passing snugly through the tube walls.

According to a further feature of the invention methodology, the burner subassembly further includes further piping connected to the inlet of the control assembly; the back flange plate includes another aperture laterally offset from the aperture passing the back tube; and as the inboard end of the back tube is positioned in coaxial coupling relation to the inboard end of the front tube, the further piping of the burner subassembly passes through the other aperture in the back flange plate for coupling at its free end with a suitable source of fuel. This arrangement allows the fuel inlet pipe to be simultaneously positioned relative to the housing as the front and back housing sections are assembled.

From a constructional standpoint, the invention burner unit includes a front flange plate having an aperture; a front tube passing through the aperture and rigidly secured to the front plate; a back flange plate having an aperture; a back tube passing through the back flange plate aperture and rigidly secured to the back flange plate; means releasably coupling the inboard ends of the tubes together in coaxial relation; an annular cover coacting with the outer peripheries of the flange plates to define an enclosure enclosing the coupled inboard ends of the tubes; a control assembly positioned in the enclosure; a burner nozzle positioned in the front tube; a front pipe assembly extending from the output of the control assembly and through the tubes for connection to the inlet of the burner nozzle; and a back pipe assembly extending into the enclosure for connection to the inlet of the control assembly. This construction provides a burner unit embodying a minimum number of parts each of which is readily and inexpensively produceable.

According to a further constructional feature of the invention burner unit, the flange plates comprise circular disks; the tube apertures in the circular disks are offset with respect to the centers of the disks so that the enclosure defined between the disks is defined primarily to one side of the tubes; and the control assembly is positioned in the enclosure to that side of the tubes. This arrangement allows the use of standardized circular and tubular parts for the burner unit and provides adequate enclosure space for the various components for the control assembly and allows the ready accommodation of the burner unit to suit various N.E.M.A. standards with respect to seals, thickness of metals, connections, etc.

According to a further feature of the invention, a radiant energy heating system is provided for heating a defined area. The system includes a burner; an elongated radiant energy heater tube extending through the area to be heated and including an inlet end secured to the outlet conduit of the burner so as to receive the combustion products exiting from the burner nozzle and coacting with the burner to define an air and combustion products path extending from the burner inlet to the exhaust end of the tube; power means positioned along the path and operative to positively move air and combustion products along the path from the burner inlet to the exhaust end of the tube; and a back draft damper positioned along the path and operative to open in response to such positive movement of air and combustion products along the path and close in response to cessation of such positive movement upon deenergization of the power means. This arrangement effects an energy saving during down time of the system by precluding retrograde cold air flow through the system and further precludes damage to the delicate control components of the system by precluding retrograde movement of hot exhaust products through the system during system down time. In the disclosed embodiment of the invention, the power means comprises a power exhaust means positioned at the exhaust end of the tube and operative when energized to draw air and combustion products along the system path, and the backdraft damper is positioned in the inlet conduit of the burner and includes a valve member which is arranged to move to an open position in response to positive movement of air and combustion products along the system path and move by gravity to a closed position upon cessation of such positive movement of air and combustion products along the system path. This combination of a power exhaust system for moving air and combustion products positively through the system and a gravity operated backdraft damper provides a simple and effective means of conserving energy during down time and precluding harmful retrograde movement of hot exhaust products through the system during down time.

DETAILED DESCRIPTION OF THE PREFERRED EMBODIMENT

Figure 6:
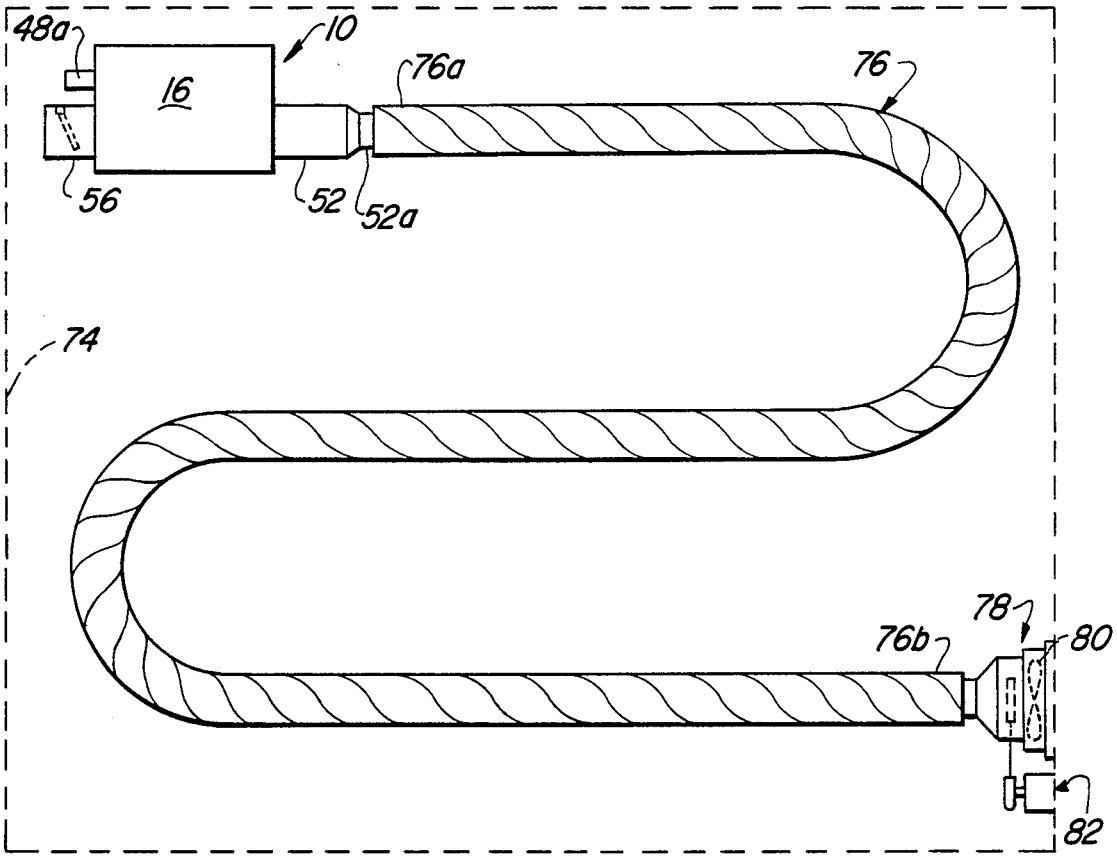
FIG. 6 is a somewhat schematic view showing the invention burner incorporated in a radiant energy space heating system.

The burner unit 10 of the invention has many applications but is particularly suited for use in radiant energy heating systems of the type comprising a burner unit and an elongated emitting tube coupled to outlet of the burner and typically disposed overhead in the area to be heated. Such a radiant heat energy heating system is shown in FIG. 6, and radiant energy heating systems of this general type are shown for example in U.S. Pat. Nos 4,044,751 and 4,529,123, both assigned to the assignee of the present invention.

The burner unit of the present invention, broadly considered, comprises a burner subassembly 11; a front housing subassembly 12; a back housing subassembly 14; and a cover 16.

Burner subassembly 11 includes a burner nozzle 18; a control assembly 20; a front pipe assembly 22; and a rear pipe assembly 24.

Burner nozzle 18 is of known construction and may contemplate gas firing, oil firing, or a combination of both.

Control assembly 20 is shown schematically and my include, for example, a regulator valve 26, a control unit 28 controlling the operation of valve 26, and a transformer 30 operative to convert incoming 110 unit AC on lines 32 to 24 volts DC for use by the solenoid valves of the control unit 28. Control assembly 20 is of known form and may, for example, include a low fire valve, a high fire valve, a gas pressure regulator, and a shut-off regulator mechanism.

Front pipe assembly 22 extends between the inlet of burner nozzle 18 and the outlet of the regulator valve 26 of control assembly 20. Pipe assembly 22 may include a threaded pipe 34; an elbow 36; a further threaded pipe 38; a further elbow 40; and a further threaded pipe 42. Pipe assembly 22 positions control assembly 20 in a laterally offset position with respect to the central axis of burner nozzle 18. Control assembly 20 further includes control wires 44 and 46 extending from control unit 28 to burner nozzle 18. Control wires 46 and 44 may comprise, for example, a flame rod wire and an ignition wire.

Back pipe assembly 24 includes a threaded pipe 48 suitable secured to the inlet of the regulator valve 26 of the control assembly.

Front housing assembly 12 includes a front flange plate or disk 50 and a front tube 52.

Disk 50 has a circular configuration and is formed of a suitable metallic material. Disk 50 has an outer annular peripheral lip portion **50*a* and an aperture 50*b*** offset with respect to the center of the disk.

Front tube 52 is necked down at its front or outboard end to provide a reduced diameter portion **52*a* and includes a slot 52*b* in its back or inboard end extending axially of the tube and opening at the inboard end of the tube. A pair of opposed radial slots 52*c* communicate with axial slot 52*b* adjacent the blind end 52*d* of the axial slot. Slot 52*b* has a width slightly in excess of the diameter of threaded pipe 38 of front pipe assembly 22, and blind end 52*d* has a semicircular configuration generally conforming to the semicircular configuration of threaded pipe 38 so that pipe 38 may readily enter slot 52*b* and seat conformingly in slot blind end 52*d***.

Front tube 52 passes through aperture **50*b* in disk 50 and is suitable secured, as by welding, to the disk 50**.

Back housing assembly 14 includes a back flange plate or disk 54 and a back tube 56.

Disk 54 has a circular configuration and is formed of a suitable metallic material. An annular lip **54*a* is formed around the outer periphery of disk 54; an aperture 54*b* is formed in disk 54 in offset relation to the center of the disk; and a further smaller aperture 54*c* is formed in disk 54 in a laterally offset position with respect to aperture 54*b*** and generally adjacent the center of the disk.

Back tube 56 is formed of a suitable metallic material and includes an enlarged diameter, front or inboard end portion **56*a*. The inboard annular edge 56*b* of end portion 56*a* is selectively configured to define a central arcuate cutout 56*c***, generally conforming to blind end 52*d* of axial slot 52*b*, and opposed laterally extending cutouts 56*d* on either side of central arcuate cutout 56*a* having a size and configuration generally matching the size and configuration of the lateral slots 52*c* in pipe 52. The relative dimensions of slot 52*b*, cutout 56*c*, and inboard tube portion 56*a* are such that, when pipe 52 is telescopically received within enlarged portion 56*a* to position the inboard annular edge 52*e* of pipe 52 against the shoulder 56*e* at the juncture of enlarged diameter portion 56*a* and the main body portion of tube 56, cutouts 56*d* overlie the back half of slots 52*c* and cutour 56*c* coacts with blind end 52*d* of slot 52*b* to define a generally circular opening sized to pass threaded pipe 38. In the telescoped configuration of tubes 52 and 56, cutouts 56*d* and lateral slots 52*c* coact to define lateral slots for passage of control wires 44 and 46 with the control wires preferably located within the respective lateral slots by the use of grommets 58 seated in the lateral slots and centrally passing the control wires.

Figure 1:
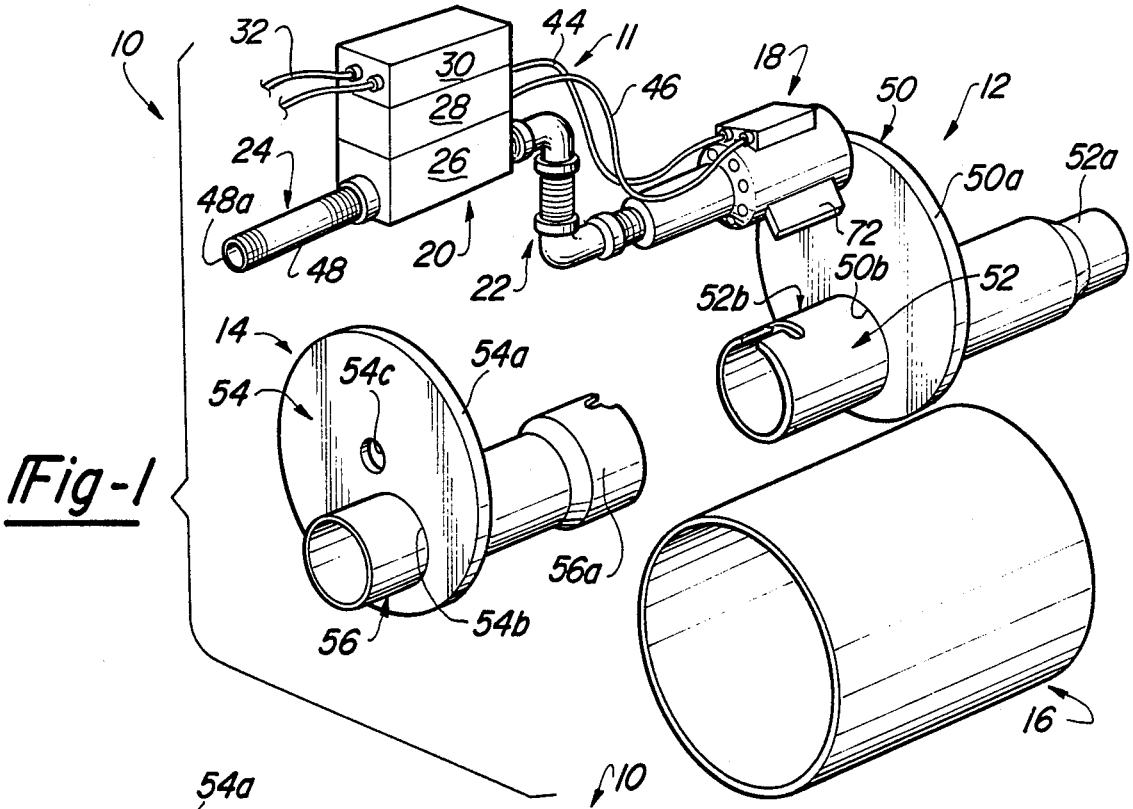
FIG. 1 is an exploded perspective view of the burner unit of the invention.
Figure 2:
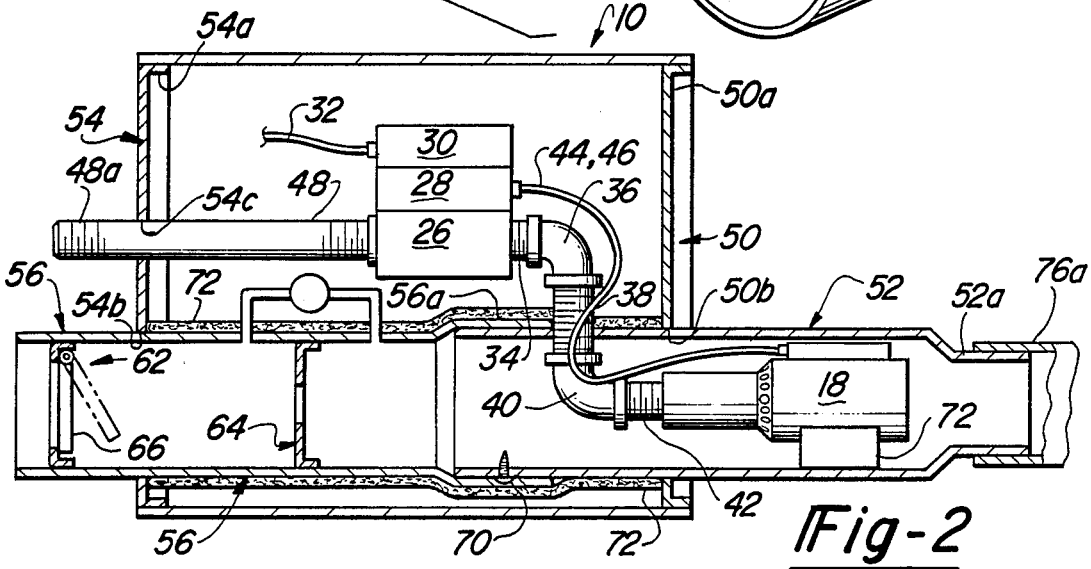
FIG. 2 is a cross sectional view of the assembled burner unit of the invention.
Figure 3:
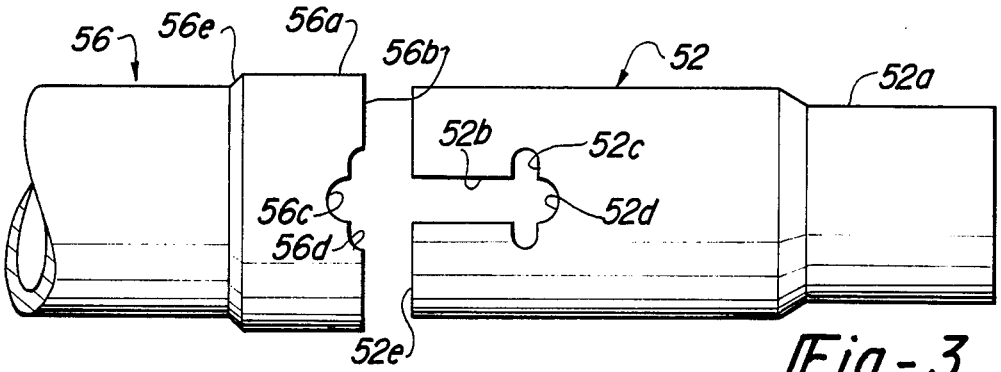
FIGS. 3 and 4 are detail views showing a coupling construction used in the invention burner unit.
Figure 5:
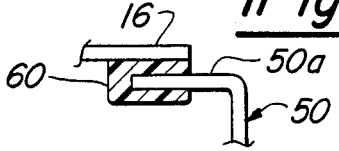
FIG. 5 is a fragmentary detail view showing an alternate cover attaching construction.

Cover 16 has a sleeve or tubular configuration and is formed of a suitable metallic material. Cover 16 is sized to coact with the outer peripheries of the flange plates 50 and 54 to define an enclosure for the control assembly. Cover 16 may be secured to flange plates 50 and 54 by any of various techniques. For example, and as seen in FIG. 2, cover 16 may fit frictionally over lips 50 and 54*a* to define the enclosure. Alternatively, a clamping band (not shown) may extend around cover 16 to secure the cover to the disk 50 and 54 or, as a further alternative, and as seen in FIG. 5, the lips 50*a* and 54*a* of disks 50 and 54 may be sealingly received in annular rubber seals 60 provided around the inner periphery of cover 16 adjacent each end of the cover. As a further alternative construction, a dimple may be provided on lip 50*a* and/or lip 54*a* for coaction with a suitable bayonet joint provided in the adjacent end portion of cover 16.

The burner assembly also includes a backdraft damper 62 positioned within the tube 56 adjacent the outboard or back end of the tube and a metering orifice member 64 positioned in tube 56 between damper 62 and the inboard or front end of the tube.

Backdraft damper 62 may take any of several known forms and may, for example, comprise, as shown, a flapper valve type with a flapper member 66; a split disk type; or a poppet valve type. Orifice 64 comprises a centrally apertured plate positioned in pipe 56 to create a pressure drop across the orifice so that a suitable sensor, as seen at 68, may sense the pressure in tube 56 upstream and downstream of metering orifice 64 to determine, in known manner, the presence or absence of sufficient fresh combustion air flowing through pipe 56 for use in the combustion process occuring in burner nozzle 18.

To assemble the invention burner unit, a burner subassembly, a front housing subassembly, and a back housing subassembly are initially prepared in bench operations preparatory to the final assembly.

The burner subassembly comprises burner nozzle 18, control assembly 20, front pipe assembly 22, and rear pipe assembly 24 with control wires 44 and 46 extending between the control unit 28 of the control assembly and the burner nozzle.

The front housing assembly comprises disk 50 with tube 52 passing through aperture 50*b* and the tube suitably rigidly secured to the disk.

The back housing subassembly comprises disk 54 with back tube 56 passing through aperture 54*d* and the tube suitably rigidly secured to the disk.

To assemble the invention burner unit, the burner nozzle 18 is inserted into the inboard end of front tube 52 of the front housing subassembly while passing threaded pipe 38 into slot 52*b* to position the threaded pipe adjacent the blind end 52*d* of the axial slot with care being taken to ensure that the control wires 44, 46 end up positioned in the respective lateral slots 52*c*. One of more locating spiders 72 may be provided on burner nozzle 18 to positively center the nozzle within tube 52. The enlarged inboard portion 56*a* of back tube 56 of the back housing subassembly is now passed over the inboard end of tube 52 to position cutouts 56*d* over slots 52*c* and position cutout 56*c* adjacent the backside of threaded pipe 38 so that cutout 56*c* coacts with blind slot end 52*d* to define a central opening passing threaded pipe 38 and trapping the pipe with respect to the front and back housing subassemblies. Grommets 58 are now positioned in the slots 52*c* to positively locate the control wires 44 and 46 within these slots, and a set screw 70 is passed through aligned holes in the inboard ends of tubes 52 and 56 to preclude axial separation of the tubes.

Burner nozzle 18 is thus positioned within front tube 52 and control assembly 20 is thus positioned in offset relation with respect to the central axis of the aligned tubes between the axially spaced disks 50 and 54. Since the apertures 50*b* and 54*b* of the disks 50 and 54 are offset with respect to the centers of the disks, the enclosure formed between the front and back disks is defined primarily to one side of the aligned tubes and the control assembly 20 is positioned within the enclosure in the enlarged space provided by the offset location of the tubes relative to the centers of the disks. As the back housing subassembly is moved into position relative to the front housing subassembly, pipe 48 of back pipe assembly 24 passes through aperture 54*c* in back disk 54 to position the free or back end 48*a* of the pipe 48 outside of the enclosure for securement to a suitable gascock or the like.

The cover 16 is now positioned over the disks 50, 54 and suitably secured to the disk, to complete the enclosure of the control assembly, by the use of any of the fastening techniques previously described.

A suitable ¼ in. insulation material 72 is provided around the portions of the assembled tubes 52, 56 positioned within the housing enclosure. The insulation material may, for example, comprise fiberglass or suitable reflective insulation. Insulation material 72 functions in the presence of extremely cold air moving though the tubes 52,56 to eliminate condensation within the enclosure of the burner unit and thereby minimize corrosive or other damage to the control assembly, and functions during movement of excessively hot air or combustion products through the tubes 52,56 to preclude heat damage to the delicate components of the control assembly.

The invention burner unit 10 is seen in FIG. 6 as part of a radiant energy system for heating a defined area such as the area within the building 74 seen in dotted lines in FIG. 6. The radiant energy heating system seen in FIG. 6, in addition to burner 10, includes an elongated radiant energy heater tube 76 extending through the area of building 74 in serpentine fashion and including an inlet end 76*a* secured to outlet conduit portion 52*a* of the burner unit so as to receive the combustion products exiting from the burner nozzle 18 through tube 52 and an outlet end 76*b* secured to the inlet of a power exhaust device 78.

Tube 76 may comprise a spirally wrapped aluminized steel emitter tube. Tubing 76 may be fabricated by offsetting an edge of flat aluminized steel stock and wrapping the stock upon itself in a spiral configuration using a commercially available tube forming machine. The tubing may thereafter be painted with a high emissivity rated paint to maximize radiant energy emissivity for given applications.

Power exhaust device 78 comprises an exhaust fan 80 driven by an electric motor 82.

Exhaust fan 80 is structured and positioned so as to draw air and combustion products positively through tube 76 and is operative to create a pressure differential across backdraft damper 56 sufficient to cause flapper member 66 to pivot upwardly to an open position to allow primary combustion air to pass through tube 56 for combustion in nozzle 18. Conversely, when motor 82 is deenergized and fan 80 is inoperative, the pressure differential across backdraft damper 56 is eliminated and flapper member 66 pivots downwardly by gravity to its closed position. In its closed position, flapper member 66 prevents cold air from entering the building through the tube 76 and burner 10 and also precludes the migration of hot gases through the tube 76 during shutdown of the heating system. The preclusion of migratory hot gases from the burner 10 is important since the hot gases could readily damage the delicate electrical equipment constituting control assembly 20. The power means 78 and backdraft damper 56 of the radiant heating system of FIG. 6 thus function to allow an unpowered backdraft damper to open automatically during operation of the heating system to provide the necessary primary combustion air, and close automatically during shutdown of the heating system to preclude energy loss and/or damage to the equipment of the control subassembly. Whereas the backdraft damper is illustrated as positioned in the inlet tube 56 and the power means 78 is shown as positioned at the exhaust end of the tube 76, it will be apparent that other locations along the path of the heating system would be feasible for both the backdraft damper and the power means.

Figure 7:
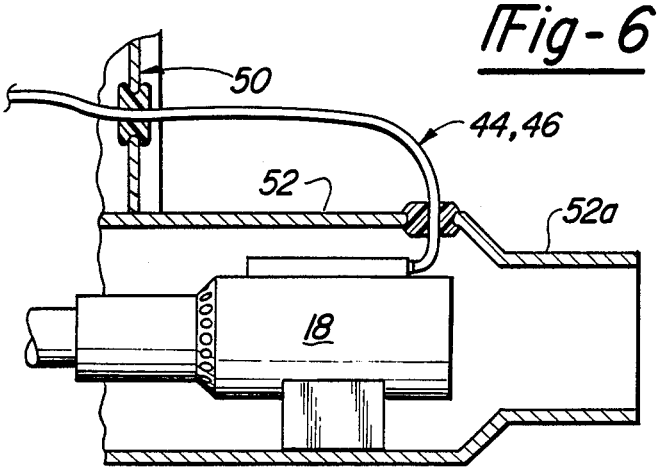
FIG. 7 is a fragmentary detail view showing a modification of the invention burner unit.
Figure 4:
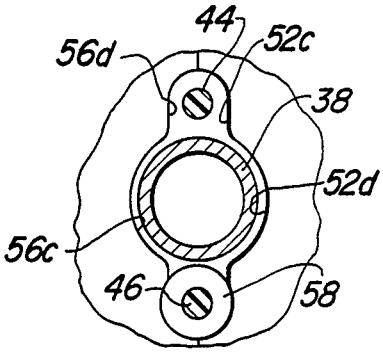

In the modified burner seen in FIG. 7, the flame rod wire 46 and ignition wire 44, rather than passing downwardly through the coupling between back tube 56 and front tube 52 and thence within tube 52 for connection to the burner nozzle, are passed outwardly through suitable apertures and grommets in disk 50 and thence though suitable apertures and grommets in front tube 52 outside of the housing enclosure for connection to burner nozzle 18. This arrangement is preferable to the arrangement shown in FIGS. 1–4 in situations where extremely hot gases are passing through tubes 56 and 52 such, for example, in situations where the invention burner unit is employing preheated air.

Figure 8:
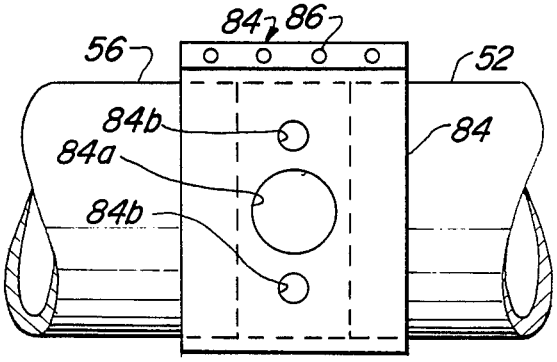
FIG. 8 is a fragmentary detail view showing a further modification of the invention burner unit.

In the modified burner construction of FIG. 8, the keyhole slot 52 in front tube 52 and the coacting notch 56 in back tube 56 are eliminated and, instead, the front and back tubes are axially spaced from each other and are joined together by a clamp or draw band 84 which secures the tubes together in axially spaced relation. A central, relatively large diameter hole **84*a* is provided in band 84 to pass pipe 38 of the control assembly, and a pair of relatively small holes 84*b* are provided on either side of central hole 84*a* to pass control wires 44 and 46. In the assembly of the burner unit of FIG. 8, draw band 84 is first assembled with respect to control unit 20 so that pipe 38 passes through central opening 84*a* and control wires 44–46 pass respectively through openings 84*b*, whereafter the draw clamp 84 is positioned over the back end of tube 52, the back housing assembly is assembled by passing the front end of back tube 56 telescopically into the rearend of clamp 84, and clamp screws 86 of drawband 84 are tightened to secure tubes 52 and 56** in their axially spaced relation.

The invention will be soon be provide a burner unit in which the number of parts comprising the total assembly is minimized; in which each of the parts is of simplified construction to minimize cost; and in which the parts, taken as a whole, lend themselves to an assembly technique that is both rapid and efficient. The simple construction of the unit and the simple process whereby the unit may be assembled facilitates the ready and inexpensive construction of the unit and allows a plurality of different sized burner units to be assembled with only minimal changes in the required parts. For example, 2½ inch, 4 inch, and 6 inch (tube diameter) burner units may be assembled using the same disks and cover unit simply by varying the size of the apertures provided in the disks and providing the desired diameter of tubing. The disk diameters and cover axial lengths are chosen such that the enclosure defined by the disks and the cover is adequate to accommodate the control assembly irrespective of the size of the tubes passing through the disks and irrespective of the size of the required control assembly.

The invention will also be seen to provide a radiant energy heating system in which a simple gravity operated backdraft damper and a power air moving device coact in a simple and inexpensive manner to provide efficient heating of the associated space and function effectively during down times to preclude retrograde movement of cold air through the heating system into the associated space and/or retrograde movement of hot gases through the system in a manner that might damage the delicate electrical components of the control assembly of the burner.

Whereas preferred embodiments of the invention has been illustrated and described in detail, it will be apparent that various changes may be made in the disclosed embodiments without departing from the scope or spirit of the invention.

I claim:

1. A burner unit comprising:

(A) a front flange plate having an aperture;

(B) a front tube passing through said aperture and rigidly secured to said front flange plate;

(C) a back flange plate having an aperture;

(D) a back tube passing through said back flange plate aperture and rigidly secured to said back flange plate;

(E) means releasably coupling the inboard ends of said tubes together in coaxial relation;

(F) an annular cover coacting with the outer peripheries of said flange plates to define an enclosure enclosing the coupled inboard ends of said tubes;

(G) a control assembly positioned within said enclosure outside of said tubes;

(H) a burner nozzle positioned in said front tube;

(I) an outlet pipe assembly extending from the outlet of said control assembly and through said tubes to the interior of said tubes for connection to said burner nozzle; and (J) an inlet pipe assembly extending into said enclosure for connection to the inlet of said control assembly.

2. A burner unit according to claim 1 wherein:
(K) said outlet pipe assembly extends through said tubes adjacent the coupled inboard ends of said tubes.
3. A burner unit according to claim 2 wherein:
(L) an axial slot is provided in said front tube opening at the inboard end thereof;
(M) the inboard end of said back tube is telescopically received over the inboard end of said front tube with the inboard annular edge of said back tube coacting with said axial slot to define an opening; and
(N) said outlet pipe assembly passes through said opening.
4. A burner unit according to claim 3 wherein:
(O) said burner unit further includes control wires extending between said control assembly and said burner nozzle; and
(P) a pair of laterally extending slots are provided at either side of said axial slot adjacent the blind end thereof for passage of said control wires.
5. A burner unit according to claim 4 wherein:
(Q) the inboard annular edge of said back tube is configured to define
(1) a central arcuate cutout coacting with the blind end of said axial slot to define a generally circular opening for passage of said first pipe assembly, and
(2) laterally extending cutouts on either side of said central arcuate cutout coacting with said laterally extending slots to define lateral slots for passage of said control wires.
6. A burner unit according to claim 2 wherein:
(K) the inboard ends of said tubes are joined together in axially spaced relation by a drawband surrounding the adjacent inboard ends of said tubes; and
(L) an opening is provided in said drawband for passage of said outlet pipe assembly.
7. A burner unit according to claim 1 wherein:
(K) said inlet pipe assembly extends into said enclosure through an aperture in said back flange plate.
8. A burner unit according to claim 1 wherein:
(K) said flange plates comprise circular disks.
9. A burner unit according to claim 8 wherein:
(L) said apertures in said circular disks are laterally offset with respect to the centers of said disks so that said enclosure is defined primarily to one side of said tubes; and
(M) said control assembly is positioned in said enclosure to said one side of said tubes.
10. A method of assembling a burner unit comprising:
(A) preparing a burner subassembly including a control assembly, a burner nozzle, and piping interconnecting the outlet of said control assembly and the inlet of said burner nozzle and positioning said control assembly in a laterally offset position relative to the central axis of the burner nozzle;
(B) preparing a front housing subassembly including a front flange plate and a front tube passing through an aperture in said front flange plate;
(C) preparing a back housing subassembly including a back flange plate and a back tube passing through an aperture in said back flange plate;
(D) inserting the burner nozzle of the burner subassembly into the inboard end of the front tube of the front housing subassembly to position the burner nozzle in coaxial relation within the front tube and position the control assembly in an offset position relative to the axis of the front tube and the burner nozzle;
(E) positioning the back tube of the back housing assembly in coaxial relation to the front tube of the front housing subassembly and coupling the inboard ends of the front and back tubes together with the piping of the burner subassembly passing laterally through the coupled tubes to position the front and back flange plates in axially spaced relation and position the control assembly between the front and back flange plates outside of the aligned and coupled inboard ends of the tubes; and
(F) positioning an axially extending annular cover over the peripheral edges of the front and back flange plates to form an enclosure enclosing the control assembly and the coupled inboard ends of the front and back tubes.
11. A method according to claim 10 wherein:
(G) the coupled inboard ends of the front and back tubes define an opening in the side walls of the coupled tubes; and
(H) the piping of the burner subassembly includes a laterally extending portion which passes through the opening in the coupled inboard ends of the tubes in the assembled condition of the burner unit.
12. A method according to claim 11 wherein:
(I) an axial slot is provided in the front tube opening at the inboard end thereof;
(J) as the burner nozzle is inserted into the front tube the laterally extending portion of the piping of the burner subassembly is slid axially into said slot; and
(K) the inboard end of the back tube is fitted telescopically over the inboard end of the front tube and the inboard annular end edge of the back tube traps the laterally extending piping portion in the blind end of said slot.
13. A method according to claim 10 wherein:
(G) said burner subassembly further includes further piping connected to the inlet of said control assembly;
(H) said back flange plate includes another aperture laterally offset from the aperture passing said back tube; and
(I) as the inboard end of the back tube is positioned in coaxial coupling relation to the inboard end of the front tube, said further piping is passed through said other aperture in said back flange plate for coupling at its free end with a suitable source of fuel.
14. A burner assembly for use in a tube type low intensity radiant energy heating system comprising:
a rigid front plate having an aperture formed therein;
a rigid back plate having an aperture formed therein;
a metal tube defining a combustion chamber;
said front plate and said back plate being mounted in spaced relationship on said tube by way of said apertures;
cover means peripherally associated with and extending between said front and back plates and coating with said front and back plates to form an enclosure enclosing said metal tube;
a fuel control assembly positioned within said enclosure outside of said tube;
a burner nozzle positioned within said tube; and
fuel conduit means extending from the outlet of said fuel control assembly and passing laterally through said tube for connection to the inlet of said nozzle.
15. Apparatus defined in claim 14 wherein said front and back plates are essentially circular and the apertures are offset from the centers thereof.

* * * * *